US007775196B2

(12) United States Patent
Suzuki et al.

(10) Patent No.: US 7,775,196 B2
(45) Date of Patent: Aug. 17, 2010

(54) FUEL SUPPLY APPARATUS

(75) Inventors: Makoto Suzuki, Mishima (JP); Tomohiro Shinagawa, Sunto-gun (JP); Yasushi Ito, Susono (JP); Rentaro Kuroki, Susono (JP); Kenichi Yamada, Yaizu (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 486 days.

(21) Appl. No.: 11/922,142

(22) PCT Filed: Jun. 28, 2006

(86) PCT No.: PCT/JP2006/313346

§ 371 (c)(1),
(2), (4) Date: Dec. 13, 2007

(87) PCT Pub. No.: WO2007/010745

PCT Pub. Date: Jan. 25, 2007

(65) Prior Publication Data

US 2009/0288647 A1 Nov. 26, 2009

(30) Foreign Application Priority Data

Jul. 21, 2005 (JP) ..... 2005-211792

(51) Int. Cl.
*F02M 27/00* (2006.01)

(52) U.S. Cl. ..... 123/538; 123/1 A; 123/2; 123/3; 123/557

(58) Field of Classification Search ..... 123/1 A, 123/2, 3, DIG. 12, 525, 543, 544, 557, 538, 123/575, 578, 537, 536, 590
See application file for complete search history.

(56) References Cited

U.S. PATENT DOCUMENTS

| | | | | |
|---|---|---|---|---|
| 2,791,990 | A * | 5/1957 | Grieb | 123/536 |
| 4,064,852 | A * | 12/1977 | Fulenwider, Jr. | 123/25 B |
| 4,237,836 | A * | 12/1980 | Tanasawa et al. | 123/472 |
| 4,344,402 | A * | 8/1982 | Child et al. | 123/538 |
| 4,401,089 | A * | 8/1983 | Csaszar et al. | 123/536 |
| 4,716,879 | A * | 1/1988 | Takayama et al. | 123/590 |
| 5,671,701 | A * | 9/1997 | O'Donnell | 123/25 A |

(Continued)

FOREIGN PATENT DOCUMENTS

JP 59-077067 A 5/1984

(Continued)

*Primary Examiner*—Michael Cuff
*Assistant Examiner*—Hung Q Nguyen
(74) *Attorney, Agent, or Firm*—Kenyon & Kenyon LLP

(57) ABSTRACT

A fuel supply apparatus that supplies fuel to an internal combustion engine by injecting liquid fuel from a fuel injection valve into a suction port is configured by a microbubble generator that generates microbubbles and an ultrasonic wave generator that generates an ultrasonic wave depending on a gas in the microbubbles generated by the microbubble generator. In the fuel supply apparatus, the generated microbubbles are mixed into the liquid fuel that is supplied to the fuel injection valve, and the liquid fuel in which the microbubbles are mixed is irradiated with the ultrasonic wave depending on the driving state of the internal combustion engine. When the liquid fuel in which the microbubbles are mixed is irradiated with the ultrasonic wave, a temperature of the liquid fuel is raised instantaneously due to contraction of the microbubbles.

8 Claims, 5 Drawing Sheets

U.S. PATENT DOCUMENTS

| | | | | | |
|---|---|---|---|---|---|
| 5,679,236 | A * | 10/1997 | Poschl | 205/351 |
| 5,829,419 | A * | 11/1998 | Sadkin et al. | 123/538 |
| 6,732,720 | B2 * | 5/2004 | Kelemencky | 123/536 |
| 6,851,413 | B1 * | 2/2005 | Tamol, Sr. | 123/536 |

FOREIGN PATENT DOCUMENTS

| | | | |
|---|---|---|---|
| JP | 59-231169 | A | 12/1984 |
| JP | 60-038548 | B | 9/1985 |
| JP | 63-078122 | U | 5/1988 |
| JP | 05-061446 | U | 4/1993 |
| JP | 06-229334 | A | 8/1994 |
| JP | 07-109959 | A | 4/1995 |
| JP | 2005-500067 | A | 1/2005 |
| WO | WO 01/36104 | A | 5/2001 |

* cited by examiner

FUEL SUPPLY APPARATUS

This is a 371 national phase application of PCT/JP2006/313346 filed 28 Jun. 2006, which claims priority to Japanese Patent Application No. 2005-211792 filed 21 Jul. 2005, the contents of which are incorporated herein by reference.

TECHNICAL FIELD

The present invention relates to a fuel supply apparatus, and more particularly to a fuel supply apparatus that supplies liquid fuel in which microbubbles are mixed to an internal combustion engine.

BACKGROUND ART

Generally, liquid fuel such as gasoline or diesel oil is supplied to an internal combustion engine by injecting the liquid fuel to a suction path or a combustion chamber from a fuel injection valve. A pressure of a space in which the liquid fuel is to be injected is lower than a pressure of the liquid fuel since the liquid fuel is pressurized by a fuel pump. Hence, the injected liquid fuel is flash boiled so that the injected fuel is atomized. However, the injected fuel cannot be atomized sufficiently when the temperature of the liquid fuel and the temperature of the space to which the liquid fuel is to be injected are low, for example, at cold start of the internal combustion engine, since the liquid fuel might not be flash boiled.

Hence, in some conventional internal combustion engines, a heater is provided so that, when the internal combustion engine is at a low temperature, the liquid fuel is heated before being supplied to an ultrasound injection valve, which atomizes the fuel by ultrasonic wave. One of such a conventional internal engine is disclosed in Japanese Utility Model Laid-Open No. H05-061446, according to which a particulate contained in exhaust gas is suppressed by ultrasonically atomizing the heated liquid fuel.

DISCLOSURE OF INVENTION

However, it is difficult to uniformly heat the supplied liquid fuel by a heating unit such as the heater. Further, the heater used to raise the temperature of the liquid fuel requires some time to raise the temperature thereof at the cold start of the internal combustion engine; therefore, the internal combustion engine cannot be started until the temperature of the heater reaches to a predetermined value.

Hence, the present invention is provided in view of the foregoing, and an object of the present invention is to provide a fuel supply apparatus that allows to atomize fuel injected from a fuel injection valve.

In order to solve the problem and to achieve the object, a fuel supply apparatus according to the present invention is for supplying fuel to an internal combustion engine by injecting liquid fuel into at least one of a cylinder and a suction port from a fuel injection valve, and includes a microbubble generator that generates microbubbles, and an ultrasonic wave generator that generates ultrasonic wave depending on a gas in the microbubbles generated by the microbubble generator. The generated microbubble are mixed into the liquid fuel supplied to the fuel injection valve and the liquid fuel in which the microbubbles are mixed is irradiated with the ultrasonic wave, depending on a driving state of the internal combustion engine.

Preferably, the fuel supply apparatus may further include a fuel temperature acquiring unit that acquires a temperature of the liquid fuel, and the microbubble generator generates the microbubbles and the ultrasonic wave generator generates the ultrasonic wave when the acquired temperature of the liquid fuel is less than or equal to a predetermined value.

According to this fuel supply apparatus, the microbubble generator mixes the microbubbles, that are ultrafine bubbles difficult to visually recognize, into the liquid fuel supplied to the internal combustion engine depending on the driving state of the internal combustion engine. For example, the microbubbles are mixed when the temperature of the liquid fuel acquired by the fuel temperature acquiring unit is less than or equal to a predetermined value such as at the cold start of the internal combustion engine. Here, the microbubbles that are mixed into the liquid fuel can be uniformly distributed therein. Further, the ultrasonic wave generator irradiates the liquid fuel mixed with the microbubbles, with the ultrasonic wave. Such ultrasonic wave depending on the gas in the microbubbles generated by the microbubble generator, and the ultrasonic wave has a frequency capable of contracting the microbubbles mixed into the liquid fuel. Therefore, the microbubbles distributed uniformly in the liquid fuel contract due to the ultrasonic wave irradiation, and a temperature of the gas in the microbubbles is instantaneously raised. Consequently, a temperature of the liquid fuel injected by the fuel injection valve can be uniformly and instantaneously raised.

Further, in the fuel supply apparatus according to the present invention, the microbubble generator may change the gas of the microbubbles that are mixed into the liquid fuel supplied to the fuel injection valve depending on the driving state of the internal combustion engine.

In the fuel supply apparatus, at least one of the gas for the microbubbles may be a gas that facilitates combustion of the liquid fuel more compared to other gas, and the microbubble generator changes the gas for the microbubbles to the gas that facilitates the combustion of the liquid fuel when the temperature of the liquid fuel is less than or equal to a predetermined value.

According to this fuel supply apparatus, the bubble generator mixes the microbubbles configured by the gas, such as hydrogen or oxygen that facilitates combustion of the fuel, into the liquid fuel supplied to the internal combustion engine depending on the driving state of the internal combustion engine, for example, when the temperature of the liquid fuel acquired by the fuel temperature acquiring unit is less than or equal to a predetermined value at the cold start of the internal combustion engine. Therefore, the liquid fuel in which the microbubbles are mixed is injected from the fuel injection valve with uniformly and instantaneously raised temperature. Consequently, combustion in the combustion chamber is facilitated due to the gas in the microbubbles, and startability of the internal combustion engine can be improved.

The fuel supply apparatus according to the present invention mixes microbubbles into liquid fuel, and irradiates the liquid fuel mixed with the microbubbles, with an ultrasonic wave. Consequently, the temperature of the liquid fuel injected from the fuel injection valve can be uniformly and instantaneously raised, and the fuel injected from the fuel injection valve can be atomized.

BEST MODE(S) FOR CARRYING OUT THE INVENTION

Embodiments of a fuel supply apparatus according to the present invention are explained below with reference to the accompanying drawings; however, the present invention in its broader aspects is not limited to the specific details and representative embodiments shown and described herein. Accordingly, elements in the following embodiments include elements that can be easily assumed by those skilled in the art or the equivalents thereof. The fuel supply apparatus explained in the following is a device to supply fuel such as gasoline and diesel oil to a gasoline engine, a diesel engine, and the like, that is installed in a vehicle such as a car and a truck.

Figure 1:
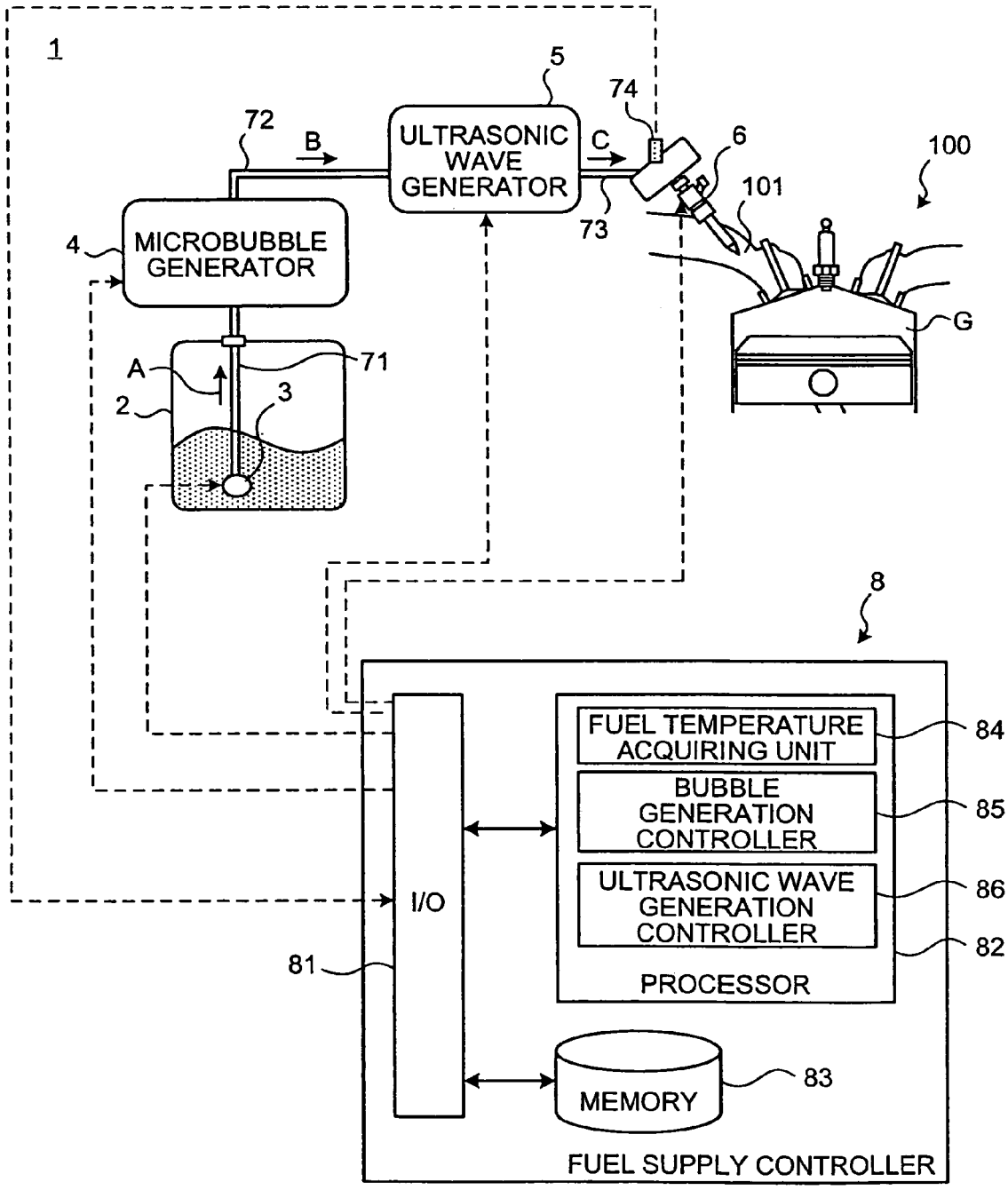
FIG. 1 shows a configuration of a fuel supply apparatus according to the present invention.
Figure 2A:
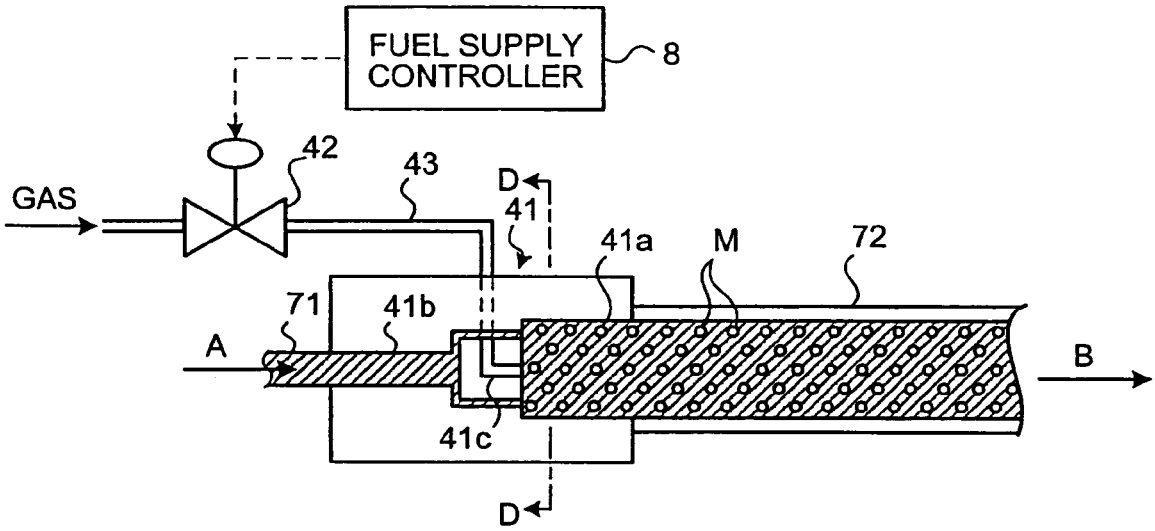
FIG. 2A shows a configuration of a microbubble generator.
Figure 2B:
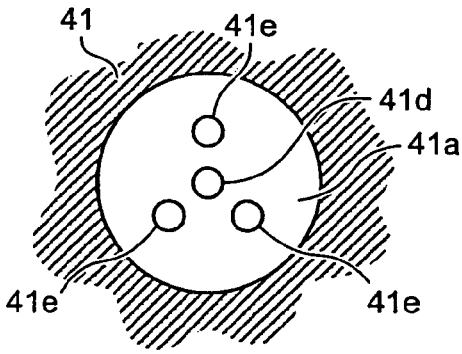
FIG. 2B is an enlarged sectional view of a relevant part of the microbubble generator (D-D sectional view of FIG. 2A)
Figure 3A:
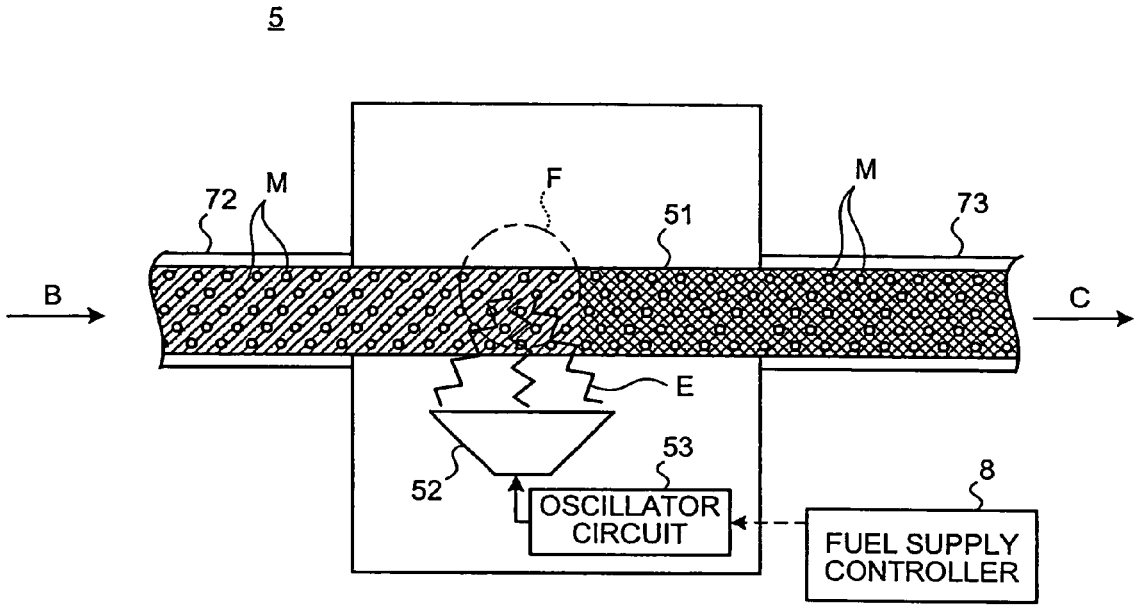
FIG. 3A shows a configuration of an ultrasonic wave generator.
Figure 3B:
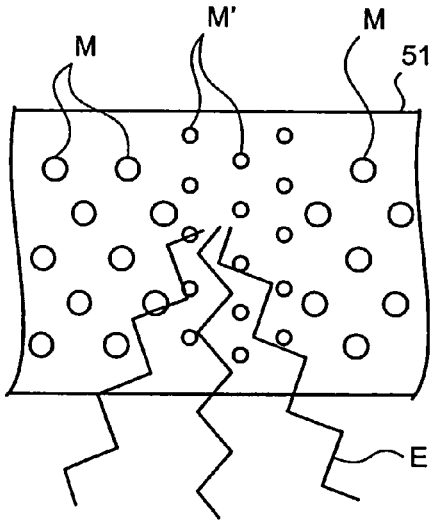
FIG. 3B is schematic drawing of a state of microbubbles (F section enlarged view of FIG. 3A)

FIG. 1 shows a configuration of a fuel supply apparatus according to the present invention. FIG. 2A shows a configuration of a microbubble generator. FIG. 2B is an enlarged sectional view of a relevant part of the microbubble generator. FIG. 3A shows a configuration of an ultrasonic wave generator. FIG. 3B is schematic drawing of a state of microbubbles. A fuel supply apparatus 1 according to the present invention supplies fuel to an internal combustion engine 100, and the fuel supply apparatus 1 is configured by a fuel tank 2, a fuel pump 3, a microbubble generator 4, an ultrasonic wave generator 5, a fuel injection valve 6, fuel supply paths 71, 72, 73, and a fuel supply controller 8.

The fuel tank 2 is a fuel storage that stores liquid fuel supplied to the internal combustion engine 100 as shown in FIG. 1, and the liquid fuel is supplied from outside to be stored in the fuel tank 2. The fuel pump 3 is arranged in the fuel tank 2.

The fuel pump 3 pressurizes the liquid fuel stored in the fuel tank 2 as shown in FIG. 1, and the fuel pump 3 is connected to the microbubble generator 4 through the fuel supply path 71. Therefore, the liquid fuel stored in the fuel tank 2 is sucked into the fuel pump 3, and the liquid fuel is pressurized by the fuel pump 3. The pressurized liquid fuel is discharged into the fuel supply path 71, and the pressurized liquid fuel is flowed into the microbubble generator 4 as shown by an arrow A of FIG. 1. The fuel pump 3 is activated by a pump activate signal outputted from the fuel supply controller 8.

The microbubble generator 4 generates microbubbles M, and the microbubble generator 4 mixes the generated microbubbles M into the liquid fuel that passes therethrough as shown in FIGS. 1 to 2B. The microbubble generator 4 is configured by a bubble generator main body 41, a gas introduction control valve 42, and a gas introduction path 43. The microbubble generator 4 is connected to the ultrasonic wave generator 5 through the fuel supply path 72. Therefore, the liquid fuel in which the generated microbubbles M are mixed flows into the ultrasonic wave generator 5 as shown by an arrow B of FIGS. 1 and 2A. Here, the microbubbles M are ultrafine bubbles difficult to visually recognize, and a diameter thereof is 50 μm and preferably has the diameter lying in a range between 20 μm and 30 μm. The microbubbles M are difficult to be absorbed by each other and difficult to be combined with each other, and the microbubbles M can float in the liquid for a long time.

The bubble generator main body 41 generates the microbubbles M, and the bubble generator main body 41 mixes the generated microbubbles M into the liquid fuel flowing out from the fuel supply path 71. Then the liquid fuel flows into the fuel supply path 72. A bubble generator 41*a* is formed in the bubble generator main body 41. The microbubble generator 4 generates the microbubbles M from gas supplied to the bubble generator 41*a*, such as air, by shear force caused by the injection of the liquid fuel into the bubble generator 41*a*.

A fuel introduction path 41*b* and a gas introduction path 41*c* that are both communicatively connected to the bubble generator 41*a* are formed in the bubble generator main body 41. One end of the bubble generator 41*a* at a downstream side with respect to a flow direction of the liquid fuel is opened and is communicatively connected to the fuel supply path 72. Further, a gas opening 41*d* that communicatively connects to one end of the gas introduction path 41*c* is formed at the center of the cross-sectioned bubble generator 41*a* and at an end of an upstream side with respect to the flow direction of the liquid fuel. A plurality of fuel openings 41*e* that communicatively connect to one end of the fuel introduction path 41*b* (this refer to branched plurality of ends in the present embodiment) are formed around the gas opening 41*d* at the end of the upstream side. Other end of the fuel introduction path 41*b* (an end at the upstream side with respect to the flow direction of the liquid fuel) is connected to the fuel supply path 71. Further, other end of the gas introduction path 41*c* is connected to one end of the gas introduction path 43.

The gas introduction control valve 42 is provided at a middle of the gas introduction path 43. The gas introduction control valve 42 opens and closes based on a control valve opening and closing signal outputted from the fuel supply controller 8.

In the first embodiment, one end of the gas introduction path 43 is connected to a gas tank (not shown) that stores high pressure gas therein. A pressure of the liquid fuel decreases as injecting the liquid fuel into the bubble generator 41*a* of the bubble generator main body 41; therefore, the gas is supplied to the bubble generator 41*a* through the gas introduction path 43 due to the pressure difference between the gas and the liquid fuel.

As shown in FIGS. 1 and 3A, the ultrasonic wave generator 5 generates an ultrasonic wave E, and the liquid fuel in which the microbubbles M are mixed is irradiated with the ultrasonic wave E. The ultrasonic wave generator 5 is configured by an ultrasonic wave irradiate path 51, an oscillator 52, and an oscillator circuit 53. The ultrasonic wave generator 5 is connected to the fuel injection valve 6 through the fuel supply path 73; therefore, the liquid fuel in which the microbubbles M irradiated with the ultrasonic wave E are mixed is supplied to the fuel injection valve 6 as shown by an arrow C of FIGS. 1 and 3A. Here, the ultrasonic wave has a frequency that can contract the gas in the microbubbles M. The microbubbles M are generated by the microbubble generator 4 and mixed into the liquid fuel. The frequency differs depending on the gas in the microbubbles M. That is to say, the ultrasonic wave generator 5 can generate the ultrasonic wave having the frequency depending on the gas in the generated microbubbles M.

One end (an end at the upstream side with respect to the flow direction of the liquid fuel) of the ultrasonic wave irradiate path 51 is connected to the fuel supply path 72, and other end thereof (an end at the downstream side with respect to the flow direction of the liquid fuel) is connected to the fuel supply path 73. The oscillator 52 is provided so that a focal point of the oscillator 52 (a focal point of the ultrasonic wave generated by the oscillator 52) is set inside the ultrasonic wave irradiate path 51. The oscillator 52 is connected to the oscillator circuit 53, and the oscillator 52 is activated by an oscillator activate signal outputted to the oscillator circuit 53 from the fuel supply controller 8.

The fuel injection valve 6 supplies the liquid fuel, which is pressurized by the fuel pump 3 and supplied through the fuel supply paths 71, 72, 73, the microbubble generator 4, and the ultrasonic wave generator 5, to the internal combustion engine 100. The fuel injection valve 6 is arranged, for example, at a suction port 101 configuring a suction path of the internal combustion engine 100 as shown in FIG. 1. Therefore, the liquid fuel, which is pressurized by the fuel pump 3 and supplied to the fuel injection valve 6, is injected to the suction port 101 from the fuel injection valve 6. The injected liquid fuel is supplied to a combustion chamber G of each cylinder not shown of the internal combustion engine 100 through the suction port 101. The fuel injection valve 6 is controlled so that injection thereof, such as timing of the injection, and an amount of the injection are controlled by an injection signal outputted from the fuel supply controller 8. Further, the fuel injection valve 6 is provided for each cylinder not shown since the suction port 101 is provided for each cylinder not shown of the internal combustion engine 100. The fuel injection valve 6 is configured so that the liquid fuel is injected to the suction port 101; however, the present invention is not limited to the embodiment described above, and the liquid fuel can be directly injected into the combustion chamber G. In other words, the liquid fuel can be directly injected into the cylinder.

Here, 74 represents a fuel temperature sensor, which is a fuel temperature detector that detects the temperature of the liquid fuel supplied to the fuel injection valve 6, for outputting the temperature to the fuel supply controller 8.

The fuel supply controller 8 is a bubble generation controller that controls generation of the microbubbles M, as well as is an ultrasonic wave generation controller that controls generation of the ultrasonic wave. The fuel temperature detected by the fuel temperature sensor 74 is inputted to the fuel supply controller 8, and the fuel supply controller 8 controls the microbubble generator 4 and the ultrasonic wave generator 5 based on the inputted fuel temperature.

Specifically, the fuel supply controller 8 is configured by an input and output part (I/O) 81 that inputs and outputs an input signal and an output signal, a processor 82 that at least has functions of controlling the generation of the microbubbles M by the microbubble generator 4 and the generation of the ultrasonic wave E by the ultrasonic wave generator 5, and a memory 83. The processor 82 includes a fuel temperature acquiring unit 84, a bubble generation controller 85, and an ultrasonic wave generation controller 86. Further, the processor 82 can be configured by the memory and a CPU (Central Processing Unit), and control of the fuel supply controller 8 can be realized by loading a program to the memory and executing the program. The program is based on a way of controlling the microbubble generator and the like. The memory 83 can be configured by a non-volatile memory such as a flash memory, a memory that is readable such as a ROM (Read Only Memory), a memory that is readable and writable such as a RAM (Random Access Memory), or a combination of the memories mentioned. The fuel supply controller 8 is not necessarily configured separately. An ECU (Engine Control Unit) that controls the driving of the internal combustion engine 100 may include the function of the fuel supply controller 8.

Figure 4:
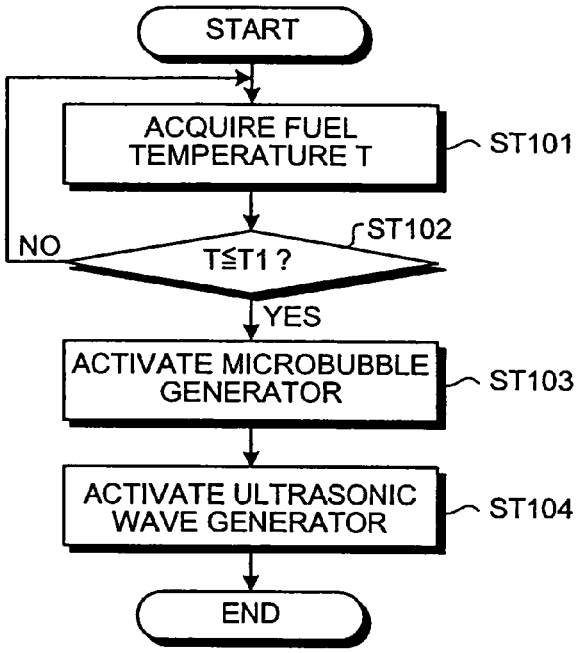
FIG. 4 is a control flow chart of a fuel supply apparatus according to a first embodiment.

An operation of the fuel supply apparatus 1 according to the first embodiment is explained next. More particularly, a way of controlling the microbubble generator 4 and the ultrasonic wave generator 5 is explained. FIG. 4 is a control flow chart of the fuel supply apparatus according to the first embodiment. Here, the fuel supply controller 8 determines an amount of the liquid fuel supplied to the internal combustion engine 100 as well as determines the timing of the supply of the liquid fuel, depending on the driving state of the internal combustion engine 100 during a time from start until stop of the internal combustion engine 100. That is to say, the fuel supply controller 8 determines an amount of the liquid fuel injected from the fuel injection valve 6 as well as determines the timing of the injection of the liquid fuel. Specifically, while supplying the fuel to the internal combustion engine 100, the fuel injection controller 8 outputs a pump activate signal to the fuel pump 3 to drive the fuel pump 3, and supplies the liquid fuel stored in the fuel tank 2 to the fuel injection valve 6. Here, the liquid fuel supplied to the fuel injection valve 6 is pressurized by the fuel pump 3. Then, the fuel supply controller 8 controls the fuel injection valve 6 based on information of the driving state of the internal combustion engine 100 inputted, such as engine revolutions and accelerator opening. Also, the fuel supply controller 8 controls the fuel injection valve 6 based on a map of an amount of injection of the liquid fuel. Here, the map is based on engine revolutions, accelerator opening, and the like memorized in the memory 83.

The fuel temperature acquiring unit 84 of the processor 82 of the fuel supply controller 8 acquires a temperature T of the liquid fuel by the fuel supply controller 8 while the liquid fuel is supplied to the internal combustion engine 100 (step ST101). Specifically, the temperature T of the liquid fuel supplied to the fuel injection valve 6 is acquired. Here, the temperature T is detected by the fuel temperature sensor 74 and outputted to the fuel supply controller 8.

Next, the bubble generation controller 85 of the processor 82 determines whether the temperature T of the liquid fuel acquired by the fuel temperature acquiring unit 84 is less than or equal to a predetermined value T1 or not (step ST102). The predetermined value T1 is a temperature in which the liquid fuel injected from the fuel injection valve 6 is difficult to be flash boiled so that the liquid fuel is difficult to be atomized, such as the temperature of the liquid fuel at the cold start of the internal combustion engine 100. The fuel temperature acquiring unit 84 of the processor 82 repeats to acquire the temperature T of the liquid fuel until the acquired temperature T of the liquid fuel becomes less than or equal to the predetermined value T1.

Next, the microbubble generator 4 is activated by the bubble generation controller 85 of the processor 82 when the bubble generation controller 85 determines that the temperature T of the liquid fuel injected from the fuel injection valve 6 is less than or equal to the predetermined value T1 (step ST103). Specifically, the bubble generation controller 85 outputs a signal to the gas introduction control valve 42 for opening and closing the gas introduction control valve 42. Consequently, the gas is supplied to the bubble generator 41*a* from the gas opening 41*d* through the gas introduction paths 43 and 41*c* by the pressure difference between the gas and the liquid fuel as described above.

The liquid fuel pressurized by the fuel pump 3 is supplied from the fuel opening 41*e* to the bubble generator 41*a* through the fuel supply path 71 and the fuel introduction path 41*b*.

Therefore, the microbubbles M are generated from the gas supplied to the bubble generator 41*a* by shear force caused by the injection of the pressurized liquid fuel into the bubble generator 41*a*, and the microbubbles M are mixed into the liquid fuel flowing into the fuel supply path 72 from the bubble generator 41*a* (see FIGS. 2A and 2B). Hence, the microbubble generator 4 generates the microbubbles M, and mixes the generated microbubbles M into the liquid fuel. The microbubble generator 4 can uniformly mix the generated microbubbles M into the liquid fuel since the microbubble generator 4 generates the microbubbles M with respect to the liquid fuel flowing through the bubble generator 41*a*. That is to say, the microbubbles M can be uniformly distributed in the liquid fuel.

Next, the ultrasonic wave generation controller 86 of the processor 82 activates the ultrasonic wave generator 5 (step ST104). Specifically, the ultrasonic wave generation controller 86 outputs an oscillator activate signal to the oscillator circuit 53, and the oscillator circuit 53 activates the oscillator 52. Consequently, the oscillator 52 generates the ultrasonic wave E as described above. In the present embodiment, the ultrasonic wave E has a frequency capable of contracting air which is the gas in the microbubbles M. The ultrasonic wave generator 5 irradiates the pressurized liquid fuel, in which the microbubbles M are mixed, flowing through the ultrasonic wave irradiate path 51 with the ultrasonic wave E (see FIG. 3A). Hence, the ultrasonic wave generation controller 86 generates the ultrasonic wave E, and the ultrasonic wave generation controller 86 irradiates the liquid fuel, in which the microbubbles M are mixed, with the ultrasonic wave E.

The microbubbles M mixed into the liquid fuel to be irradiated with the ultrasonic wave E contract to become small microbubbles M' as shown in FIG. 3B. The microbubbles M mixed into the liquid fuel repeat the contraction in a short period of time when the liquid fuel is irradiated with the ultrasonic wave E so that the temperatures of the microbubbles M' are raised instantaneously. Consequently, the temperature T of the liquid fuel in which the microbubbles M are mixed is raised instantaneously. The temperature T of the liquid fuel can uniformly be raised since the microbubbles M are uniformly distributed in the liquid fuel, as described above.

The liquid fuel having the instantaneously raised temperature is supplied to the fuel injection valve 6 with the microbubbles M that are mixed into the liquid fuel, and the liquid fuel and the microbubbles M are injected to the suction port 101 from the fuel injection valve 6. The liquid fuel injected from the fuel injection valve 6 can be flash boiled easily and can be atomized since the temperature thereof is raised. Further, the microbubbles M are flash boiled and broken since the microbubbles M are mixed in the liquid fuel injected from the fuel injection valve 6. Consequently, the fuel injected from the fuel injection valve 6 can be atomized. Therefore, startability of the internal combustion engine 100 can be improved when the temperature T of the liquid fuel is low such as at the cold start of the internal combustion engine 100 since the fuel injected from the fuel injection valve 6 can be atomized. Further, degradation of emission at the starting of the internal combustion engine 100 can be suppressed.

Air alone is used as the gas for the microbubbles M that are mixed into the liquid fuel in the first embodiment above; however, the fuel supply apparatus 1 according to the present invention is not limited to the above embodiment, and gas for the microbubbles M other than air, such as hydrogen or oxygen that facilitates the combustion of the fuel, can be mixed into the liquid fuel. Then, the ultrasonic wave generator 5 emits the ultrasonic wave E with a frequency depending on the gas in the microbubbles M. For example, when the hydrogen is used as the gas for the microbubbles M, the ultrasonic wave generator 5 irradiates the liquid fuel in which the microbubbles M are mixed with the ultrasonic wave E with a frequency that can contract the microbubbles M.

Further, the gas for the microbubbles M that are mixed into the liquid fuel can be switched depending on the driving state of the internal combustion engine 100, as described in the following as a second embodiment of the present invention. The configuration of a fuel supply apparatus according to the second embodiment is substantially the same as the configuration of the fuel supply apparatus 1 according to the first embodiment shown in FIG. 1.

Figure 5:
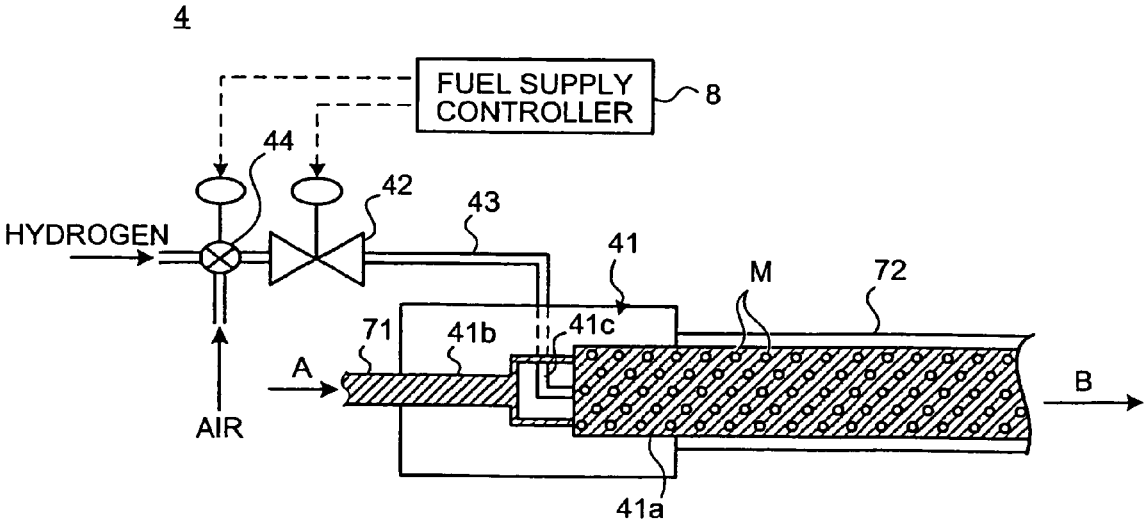
FIG. 5 shows another configuration of the microbubble generator.

FIG. 5 shows another configuration of the microbubble generator. The microbubble generator 4 is further provided with a changeover valve 44 as shown in FIG. 5, and the gas supplied to the bubble generator 41*a* through the gas introduction path 43 is switched by the changeover valve 44. At least one of the gas that can be switched is preferably a gas such as hydrogen or oxygen that can facilitate the combustion of the fuel. The microbubble generator 4 according to the second embodiment can generate the microbubbles M that are configured by one of the air and the hydrogen by switching the changeover valve 44. The changeover valve 44 changes the gas supplied to the bubble generator 41*a* in response to a changeover signal that is outputted from the fuel supply controller 8.

Figure 6:
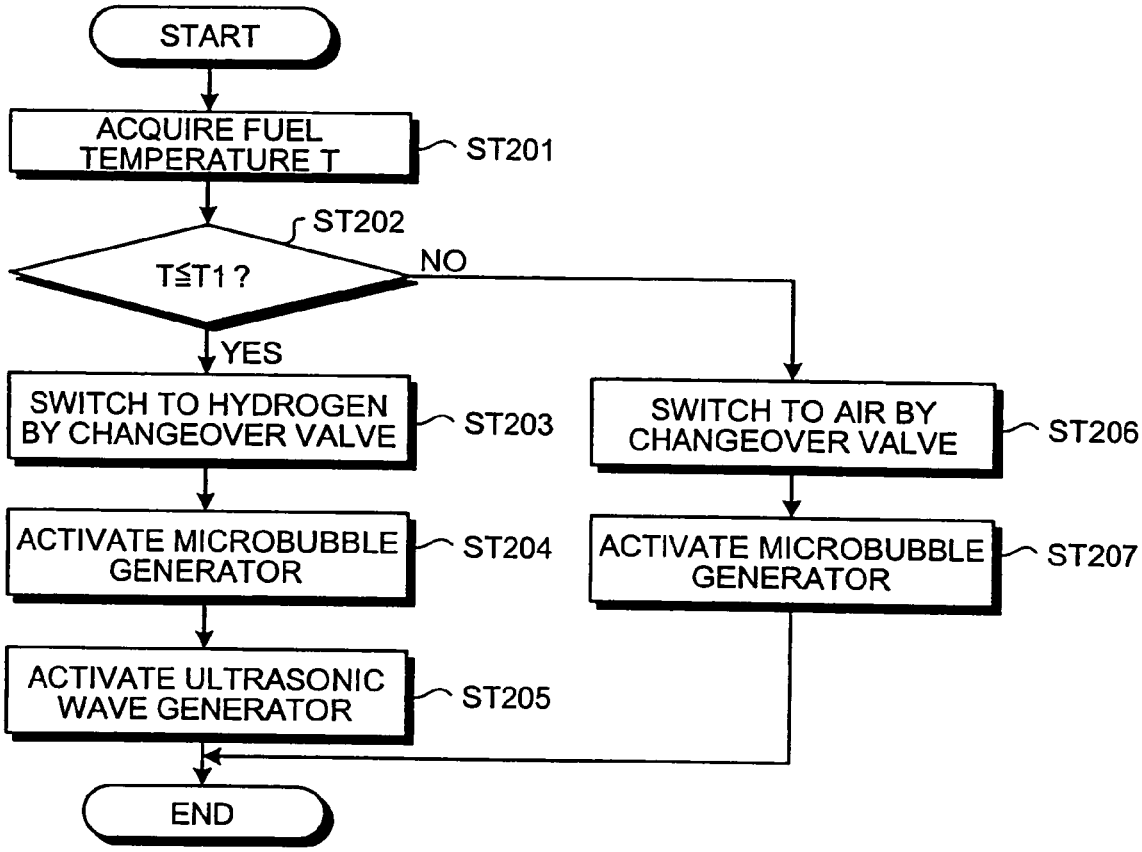
FIG. 6 is a control flow chart of a fuel supply apparatus according to a second embodiment.

Next, an operation of the fuel supply apparatus according to the second embodiment is explained. FIG. 6 is a control flow chart of the fuel supply apparatus according to the second embodiment. Explanations of the operation of the fuel supply apparatus according to the second embodiment that is identical to the operation of the fuel supply apparatus according to the first embodiment are not repeated. The fuel supply controller 8 determines the amount of the injection of the liquid fuel injected from the fuel injection valve 6 and determines the timing of the injection of the liquid fuel depending on the driving state of the internal combustion engine 100 from the start until the stop thereof, in the second embodiment.

The fuel temperature acquiring unit 84 of the processor 82 of the fuel supply controller 8 acquires the temperature T of the liquid fuel by the fuel supply controller 8 while the liquid fuel is supplied to the internal combustion engine 100 (step ST201). Next, the bubble generation controller 85 determines whether the acquired temperature T of the liquid fuel is less than or equal to the predetermined value T1 or not (step ST202).

Then, the bubble generation controller 85 of the processor 82 switches the gas flowing into the gas introduction path 43 to the hydrogen by the changeover valve 44 when the bubble generation controller 85 determines that the temperature T of the liquid fuel injected from the fuel injection valve 6 is less than or equal to the predetermined value T1 (step ST203). Specifically, the bubble generation controller 85 outputs a changeover signal to the changeover valve 44 so that the hydrogen is chosen as the gas flowing through the changeover valve 44.

Next, the bubble generation controller 85 of the processor 82 activates the microbubble generator 4 (step ST204). Specifically, the bubble generation controller 85 opens the gas introduction control valve 42 to supply the hydrogen into the bubble generator 41*a*. The microbubbles M are generated by the hydrogen supplied to the bubble generator 41*a*, and the microbubbles M are mixed into the liquid fuel (see FIG. 5).

Then, the ultrasonic wave generation controller 86 of the processor 82 activates the ultrasonic wave generator 5 (step ST205). Specifically, the ultrasonic wave generation controller 86 activates the oscillator 52 to generate the ultrasonic wave E having a frequency that can contract the hydrogen configuring the microbubbles M. The ultrasonic wave generator 5 irradiates the pressurized liquid fuel flowing through the ultrasonic wave irradiate path 51 with the ultrasonic wave E. Here, the microbubbles M are mixed into the liquid fuel (see FIG. 3A). Consequently, the temperature T of the liquid fuel in which the microbubbles M are uniformly distributed can be raised instantaneously.

The liquid fuel having the instantaneously raised temperature is supplied to the fuel injection valve 6 with the microbubbles M that are mixed into the liquid fuel, and the liquid fuel is injected to the suction port 101 from the fuel injection valve 6. The liquid fuel injected from the fuel injection valve 6 can be easily flash boiled so that the liquid fuel can be atomized, since the temperature thereof is raised. Further, the microbubbles M are flash boiled and broken, since the microbubbles M are mixed into the liquid fuel injected from the fuel injection valve 6. Furthermore, the combustion of the fuel is facilitated since the gas in the microbubbles M is hydrogen. This is because the hydrogen is a gas that can facilitate the combustion of the fuel. Therefore, startability of the internal combustion engine 100 can be remarkably improved since the fuel injected from the fuel injection valve 6 is atomized to facilitate the combustion of the fuel when the temperature T of the liquid fuel is low for example at the cold start of the internal combustion engine 100. Further, degradation of the emission while starting the internal combustion engine 100 can be suppressed.

The bubble generation controller 85 of the processor 82 switches the gas flowing into the gas introduction path 43 to air by the changeover valve 44 when the bubble generation controller 85 determines that the temperature T of the liquid fuel injected from the fuel injection valve 6 exceeds the predetermined value T1 (step ST206).

Specifically, the bubble generation controller 85 outputs the changeover signal to the changeover valve 44 to switch the gas flowing through the changeover valve 44 to the air.

Next, the bubble generation controller 85 of the processor 82 activates the microbubble generator 4 (step ST207). Specifically, the bubble generation controller 85 opens the gas introduction control valve 42 to supply the air to the bubble generator 41*a*. The microbubbles M are generated from the air supplied to the bubble generator 41*a*, and the microbubbles M are mixed into the liquid fuel (see FIG. 5).

The liquid fuel in which the microbubbles M configured by the air are mixed is supplied to the fuel injection valve 6, and the liquid fuel is injected to the suction port 101 from the fuel injection valve 6. The microbubbles M are flash boiled and broken since the microbubbles M are mixed into the liquid fuel injected from the fuel injection valve 6. Consequently, the fuel injected from the fuel injection valve 6 can be atomized. Therefore, the fuel injected from the fuel injection valve 6 can be atomized even if the temperature T of the liquid fuel is not low. Consequently, output of the internal combustion engine 100 and fuel consumption can be improved. Further, the degradation of the emission can be suppressed.

The fuel temperature acquiring unit 84 acquires the temperature T of the liquid fuel detected by the fuel temperature sensor 74 in the first and the second embodiments above; however, the present invention is not limited to the above embodiments. For example, the temperature of the liquid fuel can be predicted based on an outside temperature of the vehicle in which the internal combustion engine 100 is installed. Further, the temperature of the liquid fuel can be predicted based on a refrigerant temperature of a refrigerant circulating inside the internal combustion engine 100.

INDUSTRIAL APPLICABILITY

As described above, the fuel supply apparatus according to the present invention can be used as a fuel supply apparatus that injects liquid fuel from a fuel injection valve, and more particularly, the fuel supply apparatus according to the present invention is suitable for atomizing the fuel injected from the fuel injection valve.

The invention claimed is:

1. A fuel supply apparatus for supplying fuel to an internal combustion engine by injecting liquid fuel into at least one of a cylinder and a suction port from a fuel injection valve, comprising:

a microbubble generator that generates microbubbles, and mixes the microbubbles into the liquid fuel supplied to the fuel injection valve, depending on a driving state of the internal combustion engine; and an ultrasonic wave generator that generates an ultrasonic wave depending on a gas in the microbubbles generated by the microbubble generator, and irradiates the liquid fuel mixed with the microbubbles with the ultrasonic wave, depending on the driving state.

2. The fuel supply apparatus according to claim 1, further comprising a fuel temperature acquiring unit that acquires a temperature of the liquid fuel, wherein when the acquired temperature of the liquid fuel is less than or equal to a predetermined value, the microbubble generator generates the microbubbles and the ultrasonic wave generator generates the ultrasonic wave.

3. The fuel supply apparatus according to claim 2, further comprising an outside air temperature detector that detects an outside air temperature of a vehicle in which the internal combustion engine is installed, wherein the fuel temperature acquiring unit predicts the temperature of the liquid fuel based on the outside air temperature.

4. The fuel supply apparatus according to claim 2, further comprising a refrigerant temperature acquiring unit that detects a refrigerant temperature of a refrigerant circulating inside the internal combustion engine, wherein the fuel temperature acquiring unit predicts the temperature of the liquid fuel based on the refrigerant temperature.

5. The fuel supply apparatus according to claim 1, wherein the microbubble generator generates the microbubbles from a gas by shear force caused by injection of the liquid fuel.

6. The fuel supply apparatus according to claim 1, wherein the microbubble generator changes the gas for the microbubbles that are mixed into the liquid fuel supplied to the fuel injection valve, depending on the driving state of the internal combustion engine.

7. The fuel supply apparatus according to claim 6, wherein at least one of the gas for the microbubbles is a gas that facilitates combustion of the liquid fuel more compared to other gas, and the microbubble generator changes the gas for the microbubbles to the gas that facilitates the combustion of the liquid fuel when the temperature of the liquid fuel is less than or equal to a predetermined value.

8. The fuel supply apparatus according to claim 7, wherein the gas that facilitates the combustion of the liquid fuel is a gas containing hydrogen or oxygen.

* * * * *